US007686076B2

(12) United States Patent
York et al.

(10) Patent No.: US 7,686,076 B2
(45) Date of Patent: Mar. 30, 2010

(54) EXPANDABLE TUBULARS FOR USE IN A WELLBORE

(75) Inventors: Patrick L. York, Katy, TX (US); Robert L. Cuthbertson, Houston, TX (US); Lev Ring, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 144 days.

(21) Appl. No.: 11/359,083

(22) Filed: Feb. 22, 2006

(65) Prior Publication Data

US 2006/0185857 A1 Aug. 24, 2006

Related U.S. Application Data

(60) Provisional application No. 60/655,289, filed on Feb. 22, 2005.

(51) Int. Cl.
*E21B 23/00* (2006.01)

(52) U.S. Cl. ..... 166/207; 166/206; 166/317; 166/318; 166/380; 175/57; 175/230; 175/318

(58) Field of Classification Search ..... 166/380, 166/206, 207, 181, 317, 318; 175/57, 72, 175/318, 230

See application file for complete search history.

(56) References Cited

U.S. PATENT DOCUMENTS 1,981,525 A 11/1934 Price
6,209,663 B1 4/2001 Hosie
6,371,203 B2 4/2002 Frank et al.
6,543,552 B1 4/2003 Metcalfe et al.
6,644,110 B1 * 11/2003 Curtis et al. ..... 73/152.51
6,799,645 B2 10/2004 Mason et al.
6,962,215 B2 * 11/2005 Curtis et al. ..... 175/257

(Continued)

FOREIGN PATENT DOCUMENTS

EP 0 989 284 10/2002

(Continued)

OTHER PUBLICATIONS

Oishi et al. (Smart Composite Material System with Sensor, Actuator and Processor Functions—A Model of Holding and Releasing a Ball-; Proceedings of SPIE vol. 4701 (2002)).*

(Continued)

*Primary Examiner*—Jennifer H Gay
*Assistant Examiner*—Sean D Andrish
(74) *Attorney, Agent, or Firm*—Patterson & Sheridan, L.L.P.

(57) ABSTRACT

The present invention generally relates to methods and systems for mitigating trouble zones in a wellbore in a preferred pressure condition and completing the wellbore in the preferred pressure condition. In one aspect, a method of reinforcing a wellbore is provided. The method includes locating a valve member within the wellbore for opening and closing the wellbore. The method further includes establishing a preferred pressure condition within the wellbore and closing the valve member. The method also includes locating a tubular string having an expandable portion in the wellbore and opening the valve member. Additionally, the method includes moving the expandable portion through the opened valve member and expanding the expandable portion in the wellbore at a location below the valve member. In another aspect, a method of forming a wellbore is provided. In yet another aspect, a system for drilling a wellbore is provided.

23 Claims, 8 Drawing Sheets

U.S. PATENT DOCUMENTS

| | | | | |
|---|---|---|---|---|
| 2003/0089496 | A1* | 5/2003 | Price-Smith et al. | 166/278 |
| 2003/0196820 | A1* | 10/2003 | Patel | 166/387 |
| 2004/0011534 | A1 | 1/2004 | Simonds et al. | |
| 2004/0108140 | A1 | 6/2004 | Mason et al. | |
| 2004/0144568 | A1 | 7/2004 | Van Dijk | |
| 2004/0221996 | A1* | 11/2004 | Burge | 166/380 |
| 2006/0016623 | A1* | 1/2006 | Richard et al. | 175/57 |

FOREIGN PATENT DOCUMENTS

| | | |
|---|---|---|
| GB | 2357101 | 6/2001 |
| GB | 2394974 | 5/2004 |
| WO | WO 03/060289 | 7/2003 |

OTHER PUBLICATIONS

GB Search Report, Application No. GB0603561.2, Dated May 23, 2006.

Canadian Office Action, Application No. 2,537,333, dated Oct. 30, 2007.

GB Examination Report for Application No. GB0603561.2 dated May 27, 2009.

* cited by examiner

EXPANDABLE TUBULARS FOR USE IN A WELLBORE

CROSS-REFERENCE TO RELATED APPLICATIONS

This application claims benefit of U.S. Provisional Patent Application Ser. No. 60/655,289,filed Feb. 22, 2005,which is herein incorporated by reference.

BACKGROUND OF THE INVENTION

1.Field of the Invention

The present invention generally relates to systems and methods for drilling and completing a wellbore. More particularly, the invention relates to systems and methods for mitigating trouble zones in a wellbore in a managed pressure condition and completing the wellbore in the managed pressure condition.

2.Description of the Related Art

Historically, wells have been drilled with a column of fluid in the wellbore designed to overcome any formation pressure encountered as the wellbore is formed. This "overbalanced condition" restricts the influx of formation fluids such as oil, gas or water into the wellbore. Typically, well control is maintained by using a drilling fluid with a predetermined density to keep the hydrostatic pressure of the drilling fluid higher than the formation pressure. As the wellbore is formed, drill cuttings and small particles or "fines" are created by the drilling operation. Formation damage may occur when the hydrostatic pressure forces the drilling fluid, drill cuttings and fines into the reservoir. Further, drilling fluid may flow into the formation at a rate where little or no fluid returns to the surface. This flow of fluid into the formation can cause the "fines" to line the walls of the wellbore. Eventually, the cuttings or other solids form a wellbore "skin" along the interface between the wellbore and the formation. The wellbore skin restricts the flow of the formation fluid during a production operation and thereby damages the well.

Another form of drilling is called managed pressure drilling. An advantage of managed pressure drilling is the ability to make bottom hole pressure adjustments with minimal interruptions to the drilling progress. Another related drilling method of managed pressure drilling is underbalanced drilling. In this drilling method, the column of fluid in the wellbore is designed to be less than the formation pressure encountered as the wellbore is formed. Typically, well control is maintained by using a drilling fluid with a predetermined density to keep the hydrostatic pressure of the drilling fluid lower than the formation pressure. As the wellbore is formed, drill cuttings and small particles or "fines" are created by the drilling operation and circulated out of the wellbore resulting in minimal formation damage.

Managed pressure drilling and underbalanced drilling maximizes the production of the well by reducing skin effect and/or formation damage during the drilling operation. However, the maximization of production is negated when the well has to be killed in order to mitigate a trouble zone encountered during the managed pressure or underbalanced drilling operation. Further, the maximization of production is negated when the well has to be killed in order to complete the wellbore after the drilling operation. Presently, snubbing is a method for tripping a drill string in a constant underbalanced state. Snubbing removes the possibility of damaging the formation, but increases rig up/rig down and tripping times, adding to the operational expense. In addition, the snubbing unit cannot seal around complex assemblies, such as a solid expandable drilling liner which is typically used to mitigate a trouble zone encountered during a drilling operation. Further snubbing units cannot seal around slotted liners or conventional sand screens which are typically used in completing a wellbore.

There is a need, therefore, for an effective method and system to mitigate trouble zones encountered during an underbalanced or managed pressure drilling operation. There is a further need, therefore, for an effective method and system to complete the wellbore in an underbalanced or managed pressure condition.

SUMMARY OF THE INVENTION

The present invention generally relates to methods and systems for mitigating trouble zones in a wellbore in a preferred pressure condition and completing the wellbore in the preferred pressure condition. In one aspect, a method of reinforcing a wellbore is provided. The method includes locating a valve member within the wellbore for opening and closing the wellbore. The method further includes establishing a preferred pressure condition within the wellbore and closing the valve member. The method also includes locating a tubular string having an expandable portion in the wellbore and opening the valve member. Additionally, the method includes moving the expandable portion through the opened valve member and expanding the expandable portion in the wellbore at a location below the valve member.

In another aspect, a method of forming a wellbore is provided. The method includes separating the wellbore into a first region and a second region by closing a valve member disposed in the wellbore. The method also includes reducing the pressure in the first region and lowering a tubular string having an earth removal member and an expandable portion into the first region of the wellbore to point proximate the valve member. The method further includes establishing and maintaining a preferred pressure condition in the wellbore and opening the valve member. Additionally, the method includes moving the earth removal member and the expandable portion through the opened valve member and forming the wellbore.

In yet another aspect, a system for drilling a wellbore is provided. The system includes a tubular string having an earth removal member and an expandable portion. The system also includes a valve member located within the wellbore for substantially opening and closing the wellbore. Additionally, the system includes a fluid handling system for maintaining a portion of the wellbore in one of a managed pressure condition and an underbalanced pressure condition.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In general, the present invention relates to systems and methods for completing a wellbore in a preferred pressure condition in order to reduce wellbore damage. As will be described herein, the systems and methods are employed in a wellbore having a preferred pressure condition, such as an underbalanced or managed pressure condition. It must be noted that aspects of the present invention are not limited to these conditions, but are equally applicable to other types of wellbore conditions. Additionally, the present invention will be described as it relates to a vertical wellbore. However, it should be understood that the invention may be employed in a horizontal or deviated wellbore without departing from the principles of the present invention. To better understand the novelty of the apparatus of the present invention and the methods of use thereof, reference is hereafter made to the accompanying drawings.

Figure 1:
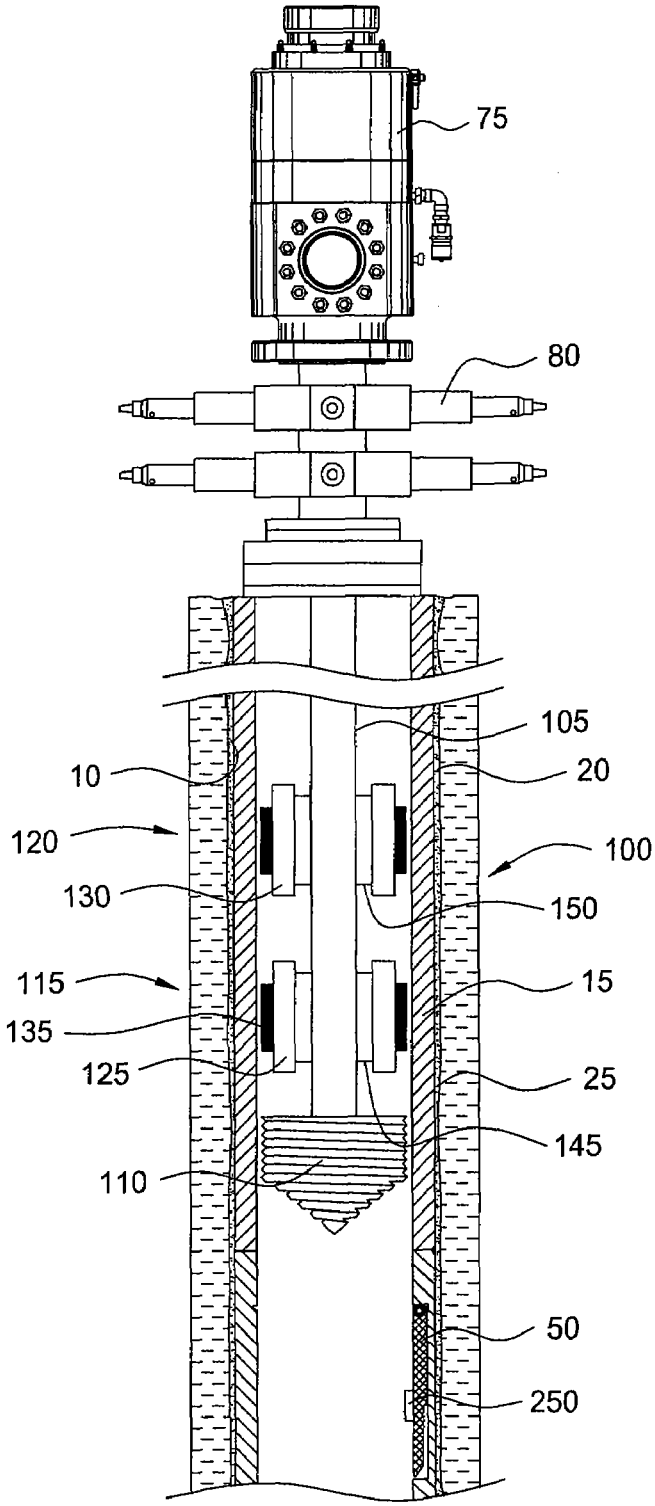
FIG. 1 is a view of a drilling assembly being lowered in a wellbore on a drill string.

FIG. 1 is a view of a drilling assembly 100 being lowered in a wellbore 10 on a drill string 105. The drilling assembly 100 includes a drill bit 110 or other earth removal member, a first carrying assembly 115 with an expandable portion 125 and a second carrying assembly 120 with an expandable portion 130. As illustrated, the wellbore 10 is lined with a string of steel pipe called casing 15. The casing 15 provides support to the wellbore 10 and facilitates the isolation of certain areas of the wellbore 10 adjacent hydrocarbon bearing formations. The casing 15 typically extends down the wellbore 10 from the surface of the well to a designated depth. An annular area 20 is thus defined between the outside of the casing 15 and the wellbore 10. This annular area 20 is filled with cement 25 pumped through a cementing system (not shown) to permanently set the casing 15 in the wellbore 10 and to facilitate the isolation of production zones and fluids at different depths within the wellbore 10.

At the surface of the wellbore 10, a rotating control head 75 is disposed on a blow out preventer (BOP) stack 80. Generally, the rotating control head 75 isolates pressurized annular returns and diverts flow away from the surface of the wellbore 10 to a choke manifold (not shown) and a separator (not shown). The rotating control head 75, which is mounted on top of the BOP stack 80, seals the drill string 105 creating a pressure barrier on the annulus side of the drill string 105 while the drill string 105 is being tripped in or out of the wellbore 10 or while it is being rotated during drilling operations. Additionally, the rotating control head 75 and the choke manifold together act as a fluid control system and are used to manage the wellbore's annular pressure, such as in a managed pressure condition or an underbalanced pressure condition.

During the underbalanced drilling operation, the reservoir fluids are allowed to flow. Therefore a surface pressure is ever present in the annulus formed between the drill string 105 and the casing 15. The rotating control head 75 is used to control the pressure at the surface of the wellbore 10. As tripping begins, and the drill string 105 is stripped through the rotating control head 75, the pressure must be managed to prevent well pressures uncontrollably forcing the drill string out 105 of the wellbore in a pipe-light situation. Generally pipe-light occurs at the point where the formation pressure across the pipe cross-section creates an upward force sufficient to overcome the downward force created by the pipe's weight.

A downhole deployment valve 50 is disposed at the lower end of the casing 15. The downhole deployment valve 50 is commonly used to shut-in oil and gas wells. The downhole deployment valve 50 may be installed in the casing 15 as shown in FIG. 1 or the downhole deployment valve 50 may be installed on a tie-back string which can be retrieved following the drilling operation. Generally, the downhole deployment valve 50 is configured to selectively block the flow of formation fluids upwardly through the casing 15 should a failure or hazardous condition occur at the well surface. Additionally, the downhole deployment valve 50 allows a wide range of systems and bottom hole assemblies to be safely and effectively deployed in an underbalanced or a mangaged pressure drilling operation. Typically, the downhole deployment valve 50 is maintained in an open position by the application of hydraulic fluid pressure transmitted to an actuating mechanism. The actuating mechanism (not shown) is charged by application of hydraulic pressure. The hydraulic pressure is commonly a clean oil supplied from a surface fluid reservoir through a control line. A pump (not shown) at the surface of the wellbore 10 delivers regulated hydraulic fluid under pressure from the surface of the wellbore 10 to the actuating mechanism through the control line. Typically, the bore through the downhole deployment valve 50 is equal to or greater than the drift diameter of the casing 15 when the downhole deployment valve 50 is in the open position.

Figure 2:
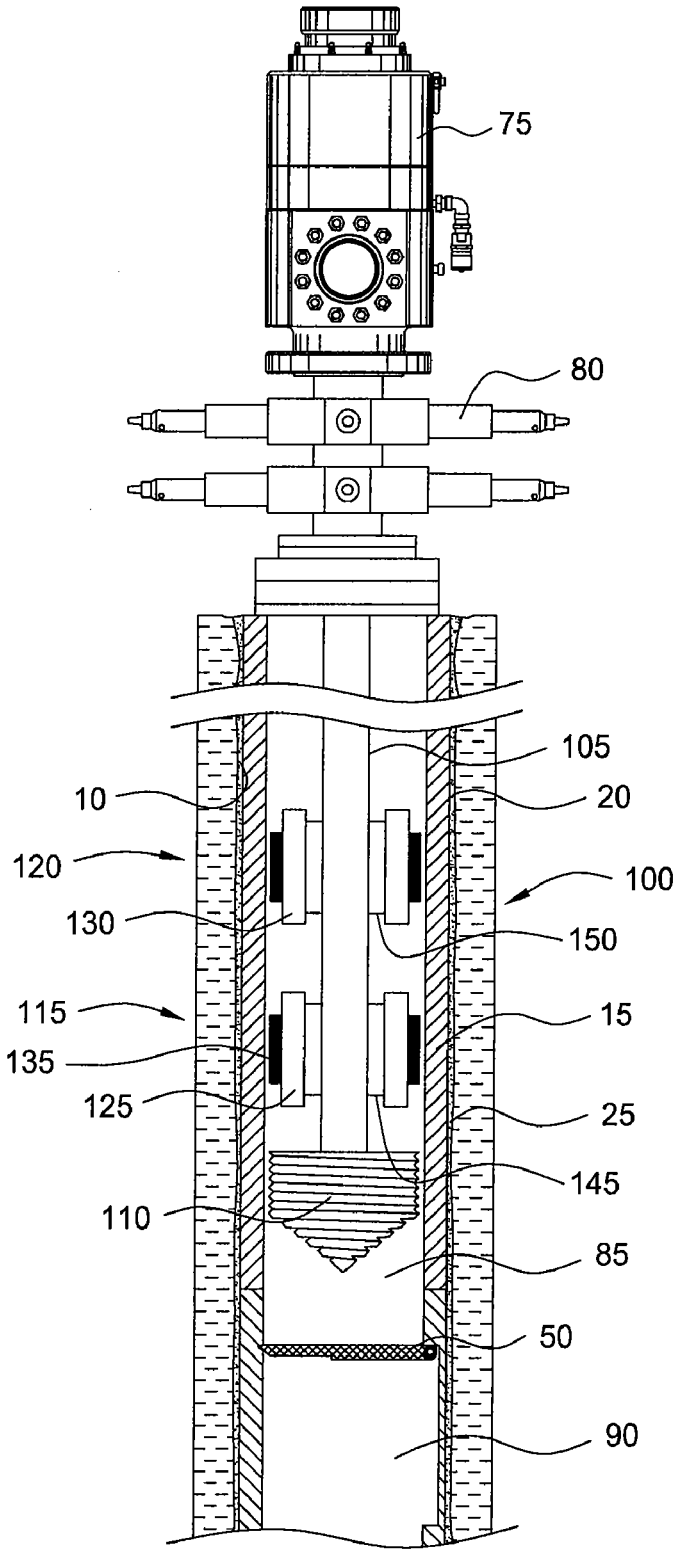
FIG. 2 is a view of the wellbore with a valve member in a closed position.

As illustrated in FIG. 1, the drilling assembly 100 is lowered into the wellbore 10 on the drill string 105 to a point proximate the downhole deployment valve 50. Pressure within the drill string 105 is controlled by closing an inner diameter of the drill string using a valve member within the drill string or a retrievable plug. Thereafter, the downhole deployment valve 50 is closed as illustrated in FIG. 2 by applying hydraulic pressure from the surface fluid reservoir through the control line.

After the downhole deployment valve 50 is closed, the wellbore 10 is separated into a first region 85 and a second region 90. The wellbore pressure in the first region is then reduced to substantially zero by manipulating the rotating control head 75 and the choke manifold system. In one embodiment, the downhole deployment valve 50 is equipped with downhole sensors 250, as shown in FIG. 1, that transmit an electrical signal to the surface, allowing measurement and reading of real-time downhole pressures.

When the wellbore pressure in the first region 85 is reduced to substantially zero, the balance of the drill string 105 is tripped out of the wellbore 10 in a similar manner as the procedure for tripping pipe in a dead well. During the trip into the wellbore 10, the drill string 105 is rerun to a depth directly above the downhole deployment valve 50, where a pipe-heavy condition exists. Subsequently, pressure is applied to the wellbore 10 to equalize the pressure in the first region 85 and the second region 90. When the pressures in the regions 85, 90 are substantially equal, hydraulic pressure from the surface fluid reservoir is applied through the control line to open the downhole deployment valve 50, thereby opening the pathway into region 90 of the wellbore 10.

Figure 3:
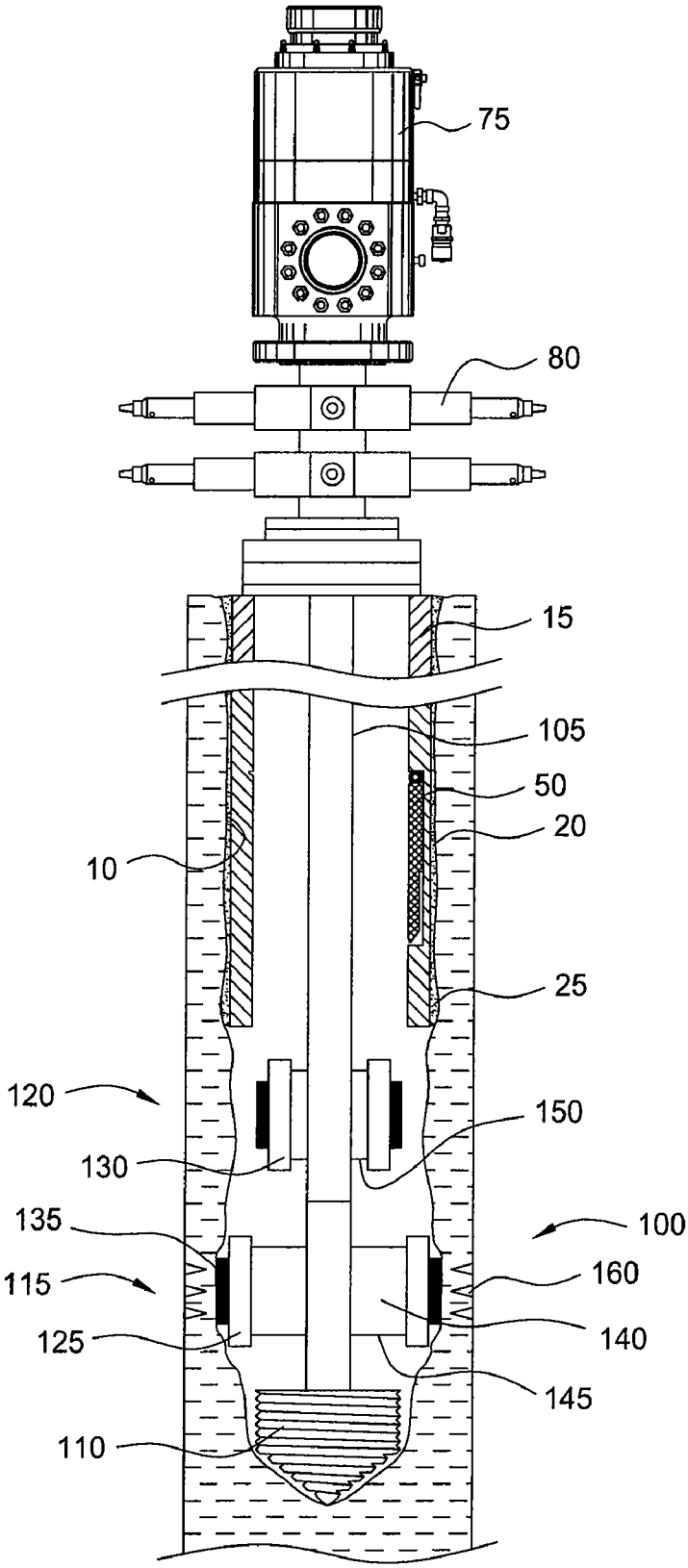
FIG. 3 illustrates the drilling assembly forming another section of the wellbore during an underbalanced or a managed pressure drilling operation.

FIG. 3 illustrates the drilling assembly 100 forming another section of the wellbore 10 during an underbalanced or a managed pressure drilling operation. Generally, the wellbore 10 is formed by rotating the drill bit 110 while urging the drilling assembly 100 downward away from the mouth of the wellbore 10. Typically, the drill bit 110 is rotated by the drill string 105 or by a downhole motor arrangement (not shown).

The wellbore 10 will be formed by the drilling assembly 100 until the drilling assembly 100 encounters a trouble zone 160. The trouble zone is a section or zone of the wellbore that negativity affects the drilling operation and/or subsequent production operation. For instance, the trouble zone may be a permeable pay zone which drains the drilling fluid from the wellbore 10. The trouble zone may also be a high pressure water flow zone which communicates high pressure water into the wellbore 10. The trouble zone may consist of a loss circulation zone that causes sloughing intervals or pressure transistions.

Figures 8A, 8B, 8C, 8D:
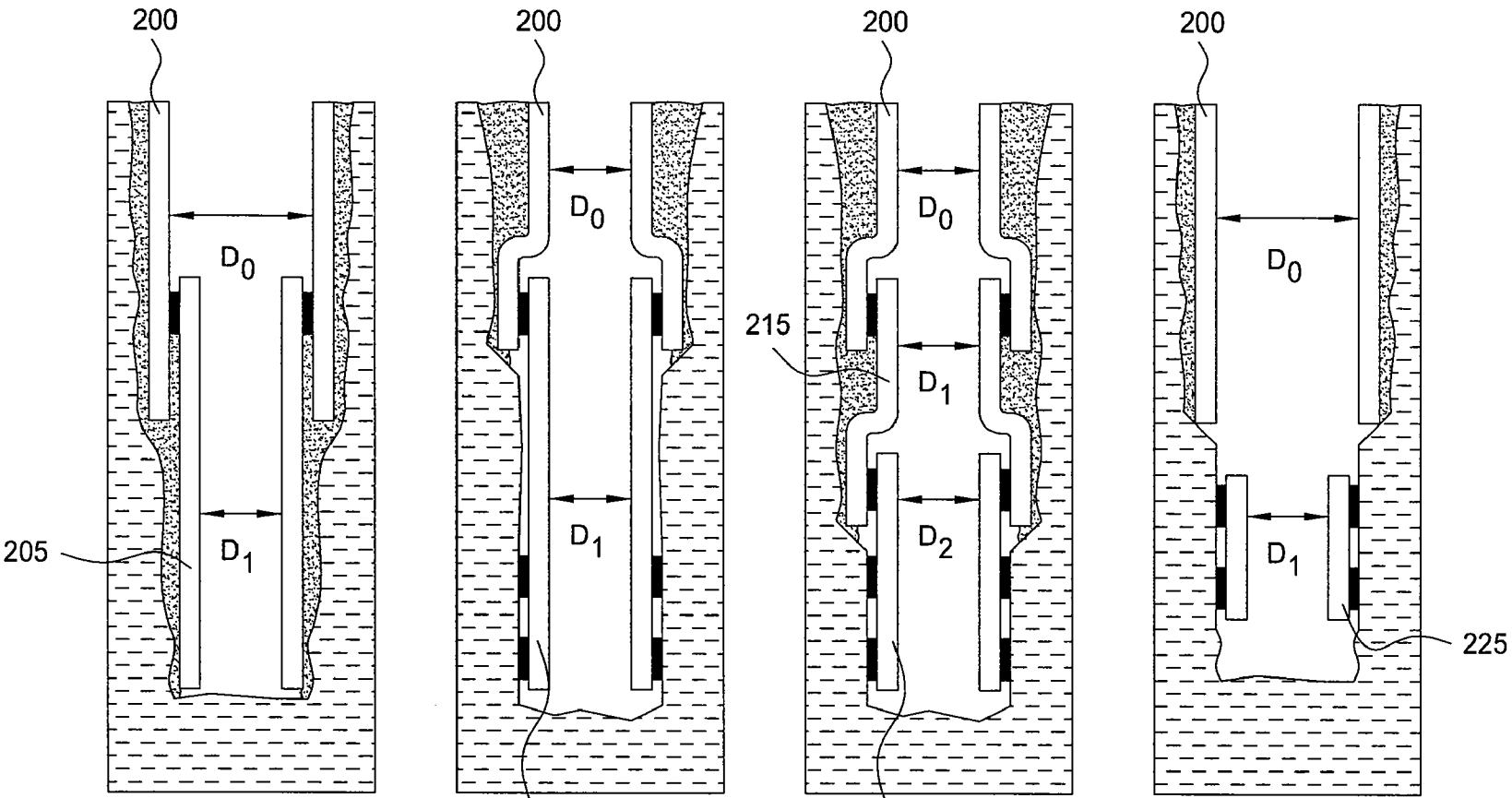
FIGS. 8A-8D illustrate different forms of the expandable portion.

Once the trouble zone 160 is encountered during the drilling operation, the trouble zone 160 must be mitigated in order to effectively continue the drilling operation. In one embodiment, the trouble zone is mitigated by isolating the trouble zone from the wellbore by placing the expandable portion 125 over the trouble zone 160. The expandable portion 125 may be an expandable clad member, an expandable liner as shown in FIGS. 8A-8C, or any other form of expandable member.

As illustrated in FIG. 3, the drilling assembly 100 is positioned in the wellbore 10 such that the first carrying assembly 115 is positioned proximate a trouble zone 160. In one embodiment, the portion of the wellbore 10 by the trouble zone 160 is enlarged or under-reamed by an under-reamer (not shown) or an expandable drill bit (not shown) prior to placing the carrying assembly 115 proximate the trouble zone 160. Thereafter, the carrying assembly 115 is activated and the expandable portion 125 is expanded radially outward into contact with the under-reamed portion of the wellbore 10. Next, the expandable portion 125 is released from the carrying assembly 115 and the drilling operation is continued.

The expandable portion 125 isolates the trouble zone 160 without loss of wellbore diameter. In other words, after expansion of the expandable portion 125, the inner diameter of the expandable portion 125 is greater than or equal to the inner diameter of the casing 15, thereby resulting in a monobore configuration. Further, the expandable portion 125 may have an anchoring member on an outside surface to allow the expandable portion 125 to grip the wellbore 10 upon expansion of the expandable portion 125. The expandable portion 125 may also have a seal member 135 disposed on an outside surface to create a sealing relationship with the wellbore 10 upon expansion of the expandable portion 125. Additionally, the expandable portion 125 may be set in the wellbore 10 with or without the use of cement.

The carrying assembly 115 may include a hydraulically activated expansion member 145 with extendable members 140 (see FIG. 3) or another type of expansion member known in the art such as solid swage or a rotary tool. Additionally, the expansion member may expand the expandable portion 125 in a top to bottom expansion or in a bottom to top expansion without departing from principles of the present invention.

In one embodiment, the expandable portion 125 is a pre-shaped or profiled tubular. After the carrying assembly 115 is positioned proximate the trouble zone 160, the carrying assembly 115 applies an internal pressure to the expandable portion 125 to substantially deform or reshape the expandable portion 125 to its original round shape and into contact with the wellbore 10. Thereafter, a rotary expansion tool or another type of expansion tool may be used to further radially expand the expandable portion 125.

Figure 4:
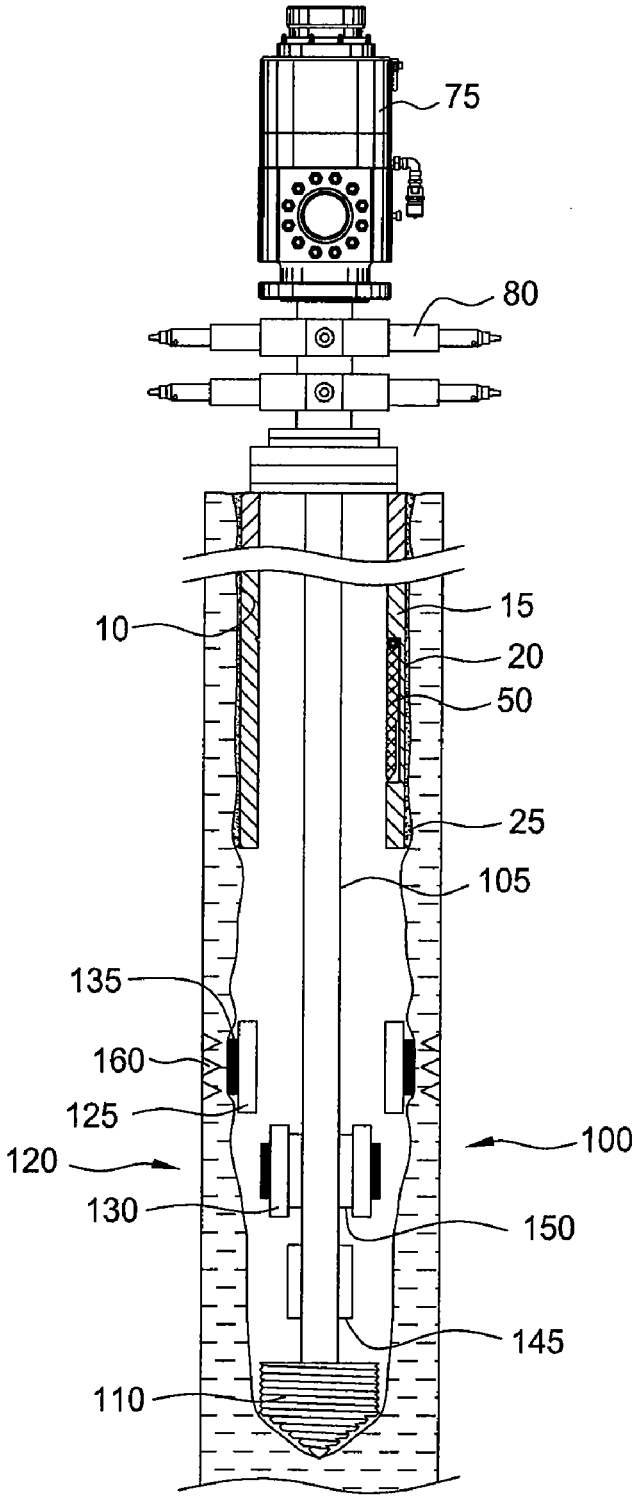
FIG. 4 illustrates the drilling assembly forming another section of the wellbore after an expandable portion has isolated a trouble zone from the surrounding wellbore.
Figure 5:
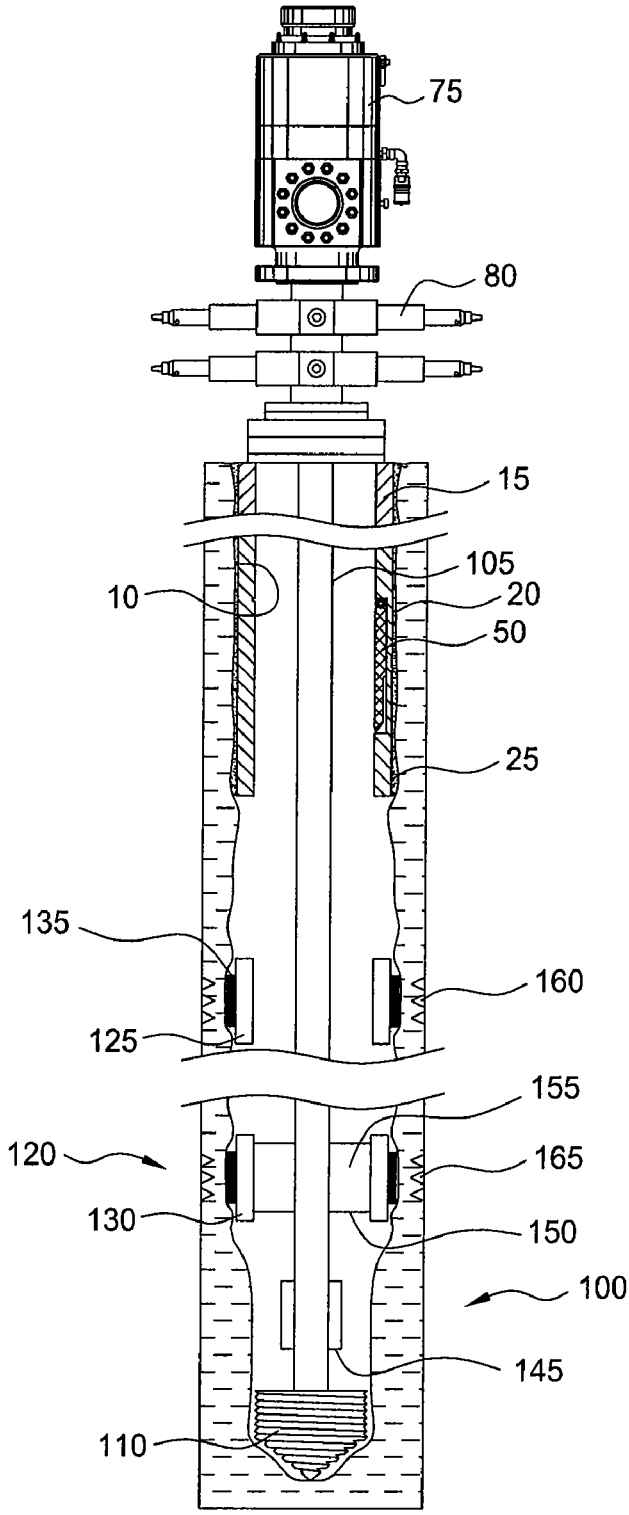
FIG. 5 illustrates the placement of a second expandable portion at another trouble zone.

FIG. 4 illustrates the drilling assembly 100 forming another section of the wellbore 10 after the expandable portion 125 has been placed in the wellbore 10. As shown, the drilling assembly 100 is urged further into the wellbore 10 and the expandable portion 130 moves through the inner diameter of the expandable portion 125. The drilling assembly 100 continues to form the wellbore 10 until another trouble zone 165 is encountered. At that point, the trouble zone 165 is mitigated by isolating the trouble zone 165 from the wellbore by placing the expandable portion 130 over the trouble zone 165 as illustrated in FIG. 5.

Similar to the process described above, the carrying assembly 120 is located in the wellbore 10 such that the expandable portion 130 is positioned proximate the trouble zone 165. Thereafter, an expansion member 150 in the carrying assembly 120 is activated and the expandable portion 130 is expanded radially outward into contact with the under-reamed portion of the wellbore 10 by extendable members 155 in the expansion member 150 (see FIG. 5) and then the expandable portion 130 is released from the carrying assembly 120. Similar to expandable portion 125, the expandable portion 130 isolates the trouble zone 165 without loss of wellbore diameter. In other words, after expansion of the expandable portion 130, the inner diameter of the expandable portion 130 is greater than or equal to the inner diameter of the casing 15 and the inner diameter of the expandable portion 125, thereby resulting in a monobore configuration.

After both expandable portions 125, 130 have been deployed, the drill string 105 is retrieved from the wellbore 10 until the lower end of the drilling assembly 100 is above the deployment valve 50. The deployment valve 50 is then closed and the annular seal is then disengaged. Thereafter, the drill string may be removed from the wellbore 10. Although the deployment of only two expandable portions has been described, more than two may be drilled in and deployed using the steps described without departing from principles of the present invention. Additionally, the Figures illustrate the drill bit 110 and the expandable portions 125, 130 lowered on the drill sting 105 at the same time. It should be understood, however, that the drill bit 110 and the expandable portions 125, 130 may be used independently without departing from principles of the present invention. In other words, the drill bit 110 may be used to form the wellbore 10 and then removed from the wellbore 10 while maintaining the preferred pressure condition. Thereafter, the expandable portion 125 may be lowered and disposed in the wellbore 10 as described herein while maintaining the preferred pressure condition.

In another embodiment the drill string 105 is deployed as described above until the first expandable portion 125 deployment is complete. At that point the drill string 105 is retrieved from the wellbore 10 until the lower end of the drill string 105 is above the deployment valve 50. The deployment valve 50 is then closed and the annular seal is then disengaged. Retrieval of the drill string 105 is then continued until the carrying assembly 115 of the drill string 105 is accessible. A second expandable portion 130 is then affixed to the carrying assembly 115.

The deployment valve 50 is then closed and the drill string 105 is reinserted into the wellbore 10 until at least the drilling assembly 100 is within the wellbore 10. The annular seal is engaged between the wellbore inner diameter and the drill string 105 and the deployment valve 50 is opened. The drill string 105 is progressed into the wellbore through the deployment valve 50 and the drill bit 110 engaged in drilling below the previously deployed expandable portion 125. The second expandable portion 130 is deployed proximate a second formation requiring control when drilling has progressed to that point. Following deployment of the second expandable portion 130 drilling may progress further or the drilling assembly 100 may be retrieved as previously described herein.

Figure 6:
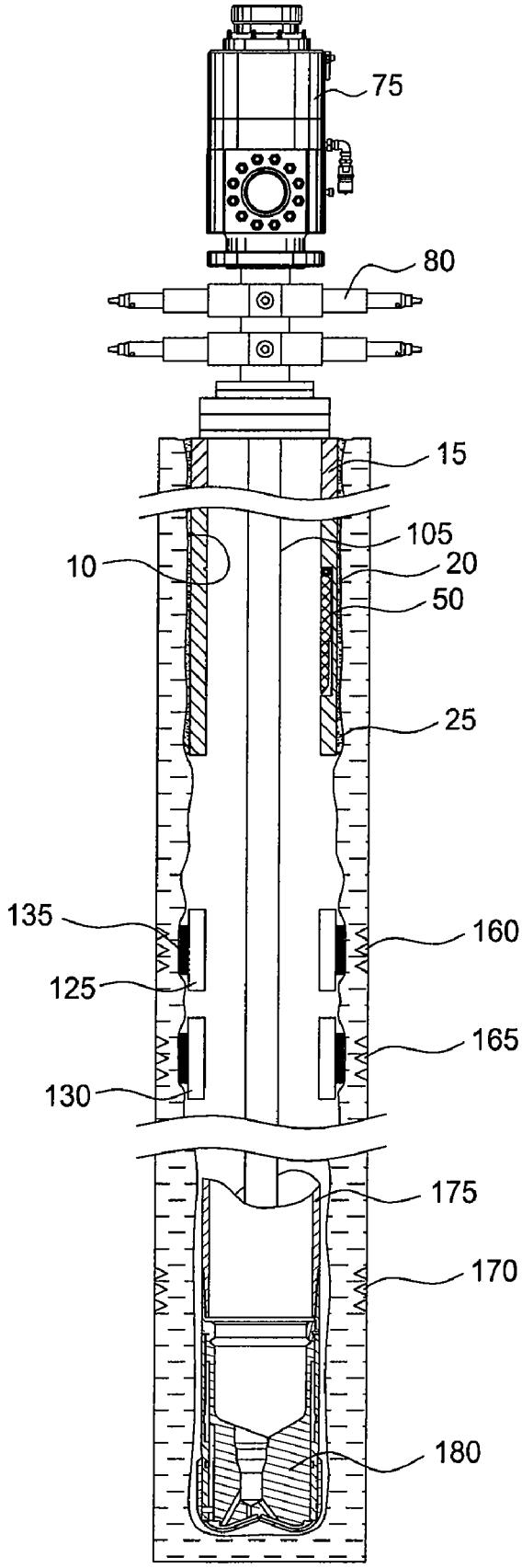
FIG. 6 illustrates a portion of the wellbore being formed by drilling with a string of casing.

FIG. 6 illustrates a portion of the wellbore 10 formed by drilling with a string of casing 175. Another type of trouble zone is a sloughing shale zone. One cause of unstable hole condition can occur in certain formations when the hydrostatic pressure of the fluid column is not sufficient to hold back the formation, resulting in sloughing of the wall of the wellbore 10. For this reason sloughing formations, especially shale sections, are somewhat common in underbalanced drilling operations. There are several different methods of remediating these type of trouble zones, such as managed pressure drilling techniques, solid expandable liners (either tied-back or not) through the use of conventional liners, or by drilling with casing or liners. Each method has its own limitations. However, drilling with casing technology has been used for both drilling through problem formations and ensuring the casing or liner can be set on bottom through unstable hole conditions.

Drilling with casing (or liners) are useful tools for drilling in difficult drilling conditions. Drilling with casing can be a relatively simple operation if the operator knows of a problem zone. For instance, a conventional assembly can be used to drill the wellbore 10 to a point just above a trouble zone 170. Thereafter, the conventional assembly may be removed and a casing string 175 with a drill bit 180 attached is introduced into the wellbore 10. Similar to the procedure previously discussed, the casing string 175 and the drill bit 180 are lowered into the wellbore 10 on the drill string 105 to a point proximate the downhole deployment valve 50. Thereafter, the downhole deployment valve 50 is closed. Next, the wellbore pressure in the first region above the valve 50 is reduced to substantially zero by manipulating the rotating control head 75 and the choke manifold system. When the wellbore pressure in the first region 85 is reduced to substantially zero, the balance of the drill string 105 is tripped out of the wellbore 10 in a similar manner as the procedure for tripping pipe in a dead well. During the trip into the wellbore 10, the drill string 105 is rerun to a depth directly above the downhole deployment valve 50, where a pipe-heavy condition exists. Subsequently, pressure is applied to the wellbore 10 to equalize the pressure in the first region and the second region below the valve 50. When the pressures in the regions are substantially equal, hydraulic pressure from the surface fluid reservoir is applied through the control line to open the downhole deployment valve 50, thereby opening the pathway into the region of the wellbore 10 below the valve 50. Then the casing string 175 and the drill bit 180 are lowered into the wellbore 10 past the expandable portions 125, 130 to form another portion of the wellbore 10 and isolate the trouble zone 170.

Generally, drilling with casing entails running the casing string 175 into the wellbore 10 with the drill bit 180 attached. The drill bit 180 is operated by rotation of the casing string 175 from the surface of the wellbore 10. Once the wellbore 10 is formed, the attached casing string 175 is cemented in the wellbore 10. Thereafter, a drilling assembly (not shown) may be employed to drill through the drill bit 180 at the end of the casing string 175 and subsequently form another portion of the wellbore 10.

In drilling the wellbore 10, the drilling assembly 100 with a directional drilling member (not shown) is tripped into the wellbore 10 through the valve 50 (and hole angle is built to horizontal). The reservoir is drilled underbalanced to a total depth. Pressure while drilling and gamma ray sensors in the guidance system, in addition to the normal directional tool face, inclination and azimuth readings, aid in maintaining proper underbalance margin and geologic settings. Multiphase flow modeling prior to and during the drilling operation insures desired equivalent circulating density (ECD) and sufficient circulation rates required for cuttings removal and good hole cleaning during Under Balanced Drilling operations. Additionally, fluid density may be adjusted, as can the injection rates of nitrogen and liquid to achieve the desired mixture density.

Figure 7:
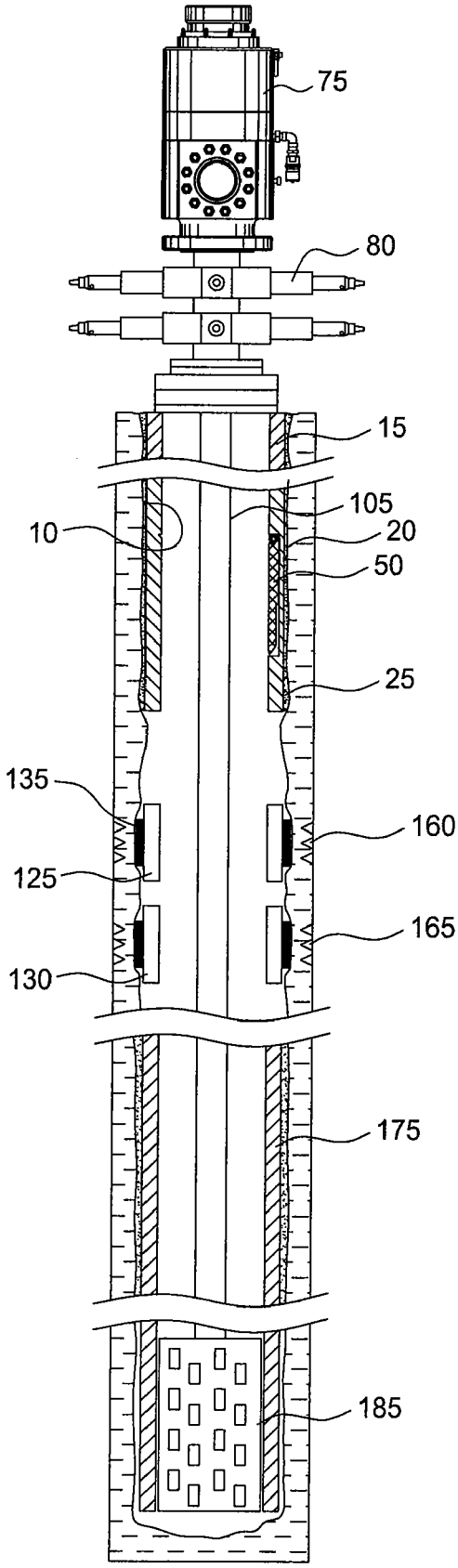
FIG. 7 illustrates a completed wellbore with an expandable filter member.

FIG. 7 illustrates the wellbore 10 with an expandable filter member 185 or a screen. For purposes of sand control, the expandable filter member 185 commonly referred to as an Expandable Sand Screen (ESS®) is useful in controlling sand and enhancing the productivity of both vertical and horizontal wells. In a similar manner as previously discussed, the expandable filter member 185 is lowered into the wellbore 10 on the drill string 105 to a point proximate the downhole deployment valve 50. Thereafter, the downhole deployment valve 50 is closed. Next, the wellbore pressure in the first region above the valve 50 is reduced to substantially zero by manipulating the rotating control head 75 and the choke manifold system. When the wellbore pressure in the first region 85 is reduced to substantially zero, the balance of the drill string 105 is tripped out of the wellbore 10 in a similar manner as the procedure for tripping pipe in a dead well. During the trip into the wellbore 10, the drill string 105 is rerun to a depth directly above the downhole deployment valve 50, where a pipe-heavy condition exists. Subsequently, pressure is applied to the wellbore 10 to equalize the pressure in the first region and the second region below the valve 50. When the pressures in the regions are substantially equal, hydraulic pressure from the surface fluid reservoir is applied through the control line to open the downhole deployment valve 50, thereby opening the pathway into the region of the wellbore 10 below the valve 50. Then the expandable filter member 185 is lowered into the wellbore 10 past the expandable portions 125, 130 and the casing string 175 to a previously formed section of the wellbore 10 in a completion operation. The ability of performing a drilling operation and completion operation in an underbalanced environment will cause less damage to the reservoir formations.

Generally, the expandable filter member 185 comprises an overlapping mesh screen, sized for the particular sieve analysis solution and sandwiched between two slotted metal tubulars, an inner base pipe and an outer shroud that covers and protects the screen. As expandable filter member 185 is expanded, the pre-cut slots in both the base and shroud pipes expand and the screen material slides over itself to provide an uninterrupted screen surface on the wellbore 10. The expandable filter member 185 maybe expanded by a rigid cone expander, a variable compliant expansion, or any other type expansion device.

In the past the greatest challenge of completing an underbalanced well using the expandable filter member 185 is deploying the porous unexpanded sand screen into a live, pressured wellbore 10. Conventional snubbing options available to solid pipe will not work with the expandable filter member 185. Killing the well to deploy the completion hardware likewise does not work because that defeats the objective of the underbalanced completion. The underbalanced drilling was possible, using snubbing equipment to trip under pressure to avoid pipe light conditions, but running sand screens was the challenge. However, the development of the valve 50 made the use of the expandable filter member 185 as an underbalanced completion system possible. As previously discussed, the valve 50 is used to drill the well underbalanced and to deploy the expandable filter member 185. Typically, the expandable filter member 185 employs a modified Axial Compliant Expansion (ACE) tool for underbalanced compliant expansion. The modified Cardium liner hanger or an expandable liner hanger is used to hang the expandable filter member 185 before expansion begins. Membrane nitrogen or another gas is used to set the hanger and then to expand the screen using the pressure translation sub between the gas and the ACE tool.

FIGS. 8A-8D illustrate the different forms of the expandable portion. For instance, FIG. 8A illustrates an expandable portion 205 disposed at an end of a casing string 200. As shown, the expandable portion 205 has an inner diameter (D1) smaller than an inner diameter (D0) of the casing string 200. FIG. 8B illustrates an expandable portion 210 disposed in a shoe portion of the casing string 200. As shown, the expandable portion 210 has an inner diameter (D1) substantially equal to an inner diameter (D0) of the casing string 200, thereby resulting in a monobore configuration. FIG. 8C illustrates an expandable portion 220 disposed in a shoe portion of the casing string 215 which is mounted in a shoe portion of the casing string 200. As shown, the expandable portion 220 has an inner diameter (D2) substantially equal to an inner diameter (D1) of the casing string 215 and an inner diameter (D0) of the casing string 200, thereby resulting in a sequential monobore configuration.

FIG. 8D illustrates an expandable portion 225 disposed below an end of the casing string 200. As shown, the expandable portion 225 has an inner diameter (D1) smaller than an inner diameter (D0) of the casing string 200. Similar to expandable portions 125, 130 as shown in FIGS. 1-7, one advantage of this embodiment is that only the trouble zone is being remediated rather than forcing the expandable casing to be installed from the trouble zone all the way back to the previous string of casing. Therefore, the expandable portion 225 requires a much shorter liner to be installed, creating a more cost effective expandable system to cure the trouble zone.

While the foregoing is directed to embodiments of the present invention, other and further embodiments of the invention may be devised without departing from the basic scope thereof, and the scope thereof is determined by the claims that follow.

The invention claimed is:

1. A method of reinforcing a wellbore comprising:

locating a valve member within the wellbore for opening and closing the wellbore;

establishing a preferred pressure condition within the wellbore;

closing the valve member;

locating a tubular string having an expandable portion in the wellbore;

opening the valve member;

progressing the expandable portion through the opened valve member;

expanding the expandable portion in the wellbore at a location below the valve member to isolate the location from other locations in the wellbore;

drilling another portion of the wellbore with a string of casing while maintaining the preferred pressure condition; and isolating a trouble zone by setting the string of casing in the wellbore.

2. The method of claim 1, wherein the preferred pressure condition is one of a managed pressure condition and an underbalanced pressure condition.

3. The method of claim 1, wherein an earth removal member is disposed on the tubular string.

4. The method of claim 1, wherein the location is the trouble zone in the wellbore.

5. The method of claim 1, further including positioning and expanding a second expandable portion in the wellbore at a location below the expandable portion.

6. The method of claim 1, further including enlarging a portion of the wellbore proximate the location prior to placement of the expandable portion.

7. The method of claim 1, further including positioning a filter member in the wellbore while maintaining the preferred pressure condition.

8. The method of claim 1, wherein the expandable portion creates a sealing relationship with the wellbore upon expansion.

9. The method of claim 1, wherein the location is below a preexisting casing string and the expandable portion has an inner diameter that is at least as large as an inner diameter of the preexisting casing string upon expansion of the expandable portion.

10. The method of claim 1, wherein the string of casing includes a drill bit attached to a lower end thereof.

11. A method of forming and completing a wellbore, the method comprising:

separating the wellbore into a first region and a second region by closing a valve member disposed in the wellbore;

reducing pressure in the first region;

lowering a tubular string having an earth removal member and an expandable portion into the first region of the wellbore to a point proximate the valve member;

establishing and maintaining a preferred pressure condition in the wellbore;

opening the valve member;

progressing the earth removal member and the expandable portion through the opened valve member;

forming the wellbore;

positioning the expandable portion proximate a trouble zone;

isolating the trouble zone by expanding the expandable portion into contact with the wellbore and creating a sealing relationship; and drilling a portion of the wellbore with a string of casing.

12. The method of claim 11, wherein the preferred pressure condition is an underbalanced pressure condition.

13. The method of claim 12, further including completing the wellbore by disposing a filter member in the wellbore while maintaining the underbalanced pressure condition.

14. The method of claim 11, wherein the expandable portion has an inner diameter at least as large as an inner diameter of a preexisting casing string upon expansion of the expandable portion.

15. A system for drilling a wellbore, the system comprising:

a tubular string having an earth removal member and an expansion device with extendable members configured to carry and expand a solid expandable tubular portion, whereby the expandable tubular portion is configured to move from a first diameter to a second larger diameter and then be selectively released from the expansion device on the tubular string to isolate a location in the wellbore and wherein the expandable tubular portion includes a seal member configured to form a seal with the wellbore upon moving the expandable tubular portion to the second larger diameter;

a valve member located within the wellbore for substantially opening and closing the wellbore; and a fluid handling system for maintaining a portion of the wellbore in one of a managed pressure condition and an underbalanced pressure condition.

16. The system of claim 15, wherein the valve member includes a sensor configured to measure and transmit real-time downhole pressures to a surface of the wellbore.

17. The system of claim 15, wherein the extendable members of the expansion member extend radially outward to expand the expandable portion.

18. The system of claim 15, wherein the tubular string further includes a directional drilling member.

19. The system of claim 15, wherein the tubular string further includes a second expandable portion.

20. A method of reinforcing a wellbore, the method comprising:

separating the wellbore into a first region and a second region by closing a valve member disposed in the wellbore;

lowering a drilling assembly into the first region of the wellbore to a point proximate the valve member, wherein the drilling assembly includes a first expandable portion attached to a first expansion device and a second expandable portion attached to a second expansion device, wherein each expansion device includes extendable members configured to carry and expand the respective expandable portion;

establishing a preferred pressure condition in the wellbore and opening the valve member;

progressing the drilling assembly through the opened valve member;

drilling a section of the wellbore using the drilling assembly;

isolating a first trouble zone in the wellbore by expanding the first expandable portion into contact with the wellbore using the first expansion device;

drilling a further section of the wellbore using the drilling assembly; and isolating a second trouble zone in the wellbore by expanding the second expandable portion into contact with the wellbore using the second expansion device.

21. The method of claim 20, wherein each expandable portion is released from the drilling assembly after expansion.

22. The method of claim 20, wherein each expandable portion is a solid expandable tubular.

23. The method of claim 20, wherein each expandable portion creates a sealing relationship with the wellbore upon expansion.

* * * * *